US007520837B1

(12) United States Patent
Sudeith et al.

(10) Patent No.: US 7,520,837 B1
(45) Date of Patent: Apr. 21, 2009

(54) CLIMBING WALL ASSEMBLY

(75) Inventors: Timothy S. Sudeith, Edina, MN (US); Jeremy Mariette, Crystal, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 576 days.

(21) Appl. No.: 11/247,497

(22) Filed: Oct. 10, 2005

Related U.S. Application Data

(60) Provisional application No. 60/617,296, filed on Oct. 8, 2004.

(51) Int. Cl.
*A63B 9/00* (2006.01)

(52) U.S. Cl. ..... 482/37; 482/35

(58) Field of Classification Search ..... 482/35–37, 482/148; 434/255; 273/440, 445
See application file for complete search history.

(56) References Cited

U.S. PATENT DOCUMENTS

| | | | | |
|---|---|---|---|---|
| 5,254,058 | A | 10/1993 | Savigny | |
| 5,732,954 | A | 3/1998 | Strickler et al. | |
| 5,944,634 | A | 8/1999 | Neves | |
| 6,074,327 | A | 6/2000 | Franklin | |
| 6,083,142 | A | 7/2000 | Wilson | |
| 6,231,482 | B1 | 5/2001 | Thompson | |
| 6,402,663 | B1 * | 6/2002 | Popp | 482/35 |
| 6,514,178 | B2 * | 2/2003 | Vettori | 482/37 |
| 6,551,216 | B2 * | 4/2003 | Rennex | 482/35 |
| 6,629,907 | B2 * | 10/2003 | Popp | 482/35 |
| 7,250,020 | B2 * | 7/2007 | Barbafieri et al. | 482/35 |
| 2003/0100407 | A1 * | 5/2003 | Barbafieri et al. | 482/37 |

* cited by examiner

*Primary Examiner*—Fenn C Mathew
(74) *Attorney, Agent, or Firm*—Anthony G. Eggink; Katrina M. Eggink

(57) ABSTRACT

A free standing climbing wall assembly having double mounted hand holds and a wall closure assembly. The wall closure assembly provides a covering to protect the climbing wall assembly and is secured in place to prevent unauthorized climbing. The protective covering may also be utilized to provide a tent-like shelter from the elements while providing access and use of the climbing wall.

20 Claims, 2 Drawing Sheets

CLIMBING WALL ASSEMBLY

This application claims the benefit of U.S. Provisional Patent Application Ser. No. 60/617,296, filed on or about Oct. 8, 2004.

BACKGROUND OF THE INVENTION

The present invention relates generally to a climbing wall assembly. Particularly, the invention relates to a double sided climbing wall assembly using a double-mounted hand hold assembly and a wall closure system.

Artificial climbing and bouldering walls are increasingly used due to physical fitness awareness and interest in climbing and bouldering sports. Climbing wall assemblies are also being provided to introduce children to the climbing sports in a safe, convenient and educational manner. Various devices have also been introduced to make climbing for children a fun and educational experience. Exemplary climbing wall assemblies and devices are disclosed in Applicant's pending U.S. patent application having Ser. No. 10/236,728, filed on Sep. 6, 2002, and in the patent application entitled Safety Mat Securement Assembly having Ser. No. 60/545,543 filed on Feb. 18, 2004, the teachings of both of which being fully incorporated by reference herein.

Climbing wall assemblies may be provided in both indoor and outdoor settings. It is desirable to secure the assemblies during periods of non-use to prevent unauthorized climbing on both the indoor and outdoor climbing walls. Particularly in outdoor settings it is also desirable to protect the climbing wall assemblies from the elements, i.e., rain, snow and sunlight.

When a climbing wall is provided indoors or outdoors, it may also be desirable for the assembly to be free standing and to have double-sided climbing wall structures so that climbing can simultaneously occur on both sides of the climbing wall. The climbing wall assembly of the present invention provides double sided climbing walls using novel handhold structures and securement systems. In a double-sided climbing wall assembly, double-mounted hand hold structures are desirable. The climbing wall closure system of the present invention provides a double-mounted hand hold structure on a climbing wall panel and a closure system for the double-sided climbing wall.

SUMMARY OF THE INVENTION

The present invention provides a free standing climbing wall assembly wherein both sides of a climbing wall may be used for climbing. The free standing climbing wall may be comprised of a wall structure held between securement members, for example. The wall structure may have a single wall structure or adjoining wall panel members to form linear, L-shaped, zig-zag or other desired free standing climbing wall assembly configurations. Securement members may be provided as end structures for a linear outdoor setting or as a plurality of securement structures, i.e., in a L-shaped wall configuration. In an outdoor setting, the securement structures may be end posts, for example, and in an indoor setting the securement structure may comprise posts having base plates, for example, to thereby stabilize the climbing wall.

Double mounted hand hold assemblies are provided in the present invention and which are comprised of opposing hand hold body structures disposed on opposite sides of a climbing wall. Hand hold attachment means are provided to join and secure the opposing structures in cooperation with the climbing wall. For example, an internally threaded nut member may be secured into an aperture in one of the hand hold body members. A cooperating bolt member having a threaded shaft is inserted in an aperture in the back of the opposing hand hold body member and screwed into the internally threaded nut member through an aperture in the climbing wall. Hand hold stabilizing means such as opposing nub members extending from the back of each hand hold body member may also be provided to fit into an aligned aperture in the climbing wall to thereby keep the hand hold body members from rotating with respect to the joining bolt. Alternatively, an elongated rod member may be provided to extend through and from the opposing climbing wall surfaces to matingly fit into apertures located in the back of the handhold body members. Further, other stabilizing means, i.e., a second attachment means or mechanical fasteners, such as, screws or an adhesive, such as, a pressure sensitive adhesive, may be used to stabilize the double handhold structure.

The climbing wall assembly of the invention also provides climbing wall closure assemblies which are constructed and arranged for use with the free-standing climbing wall assembly. The climbing wall closure assembly comprises a cover member and securement means for the freestanding climbing wall assembly. The cover member may be secured to the end securement structures and/or may be provided in a plurality of cover members when two or more securement structures are used in an L-shaped climbing wall, for example. The flexible cover(s) or sleeve member preferably covers both sides of a freestanding climbing wall and is secured into a locked position. Loop members or other securement means, such as grommets, for example, may be attached to or extend from the cover member and secured in a security hand hold or to a ground hook, clasp or another loop using a lock, or any other fastening means known in the art. The locked position prevents unauthorized climbing and protects the climbing wall from the elements. The cover may be constructed of natural or synthetic matting materials, vinyl, mesh or like flexible and pliable materials.

Another embodiment of the wall closure system may include the ability to provide a shelter structure having support structures or end poles for protection from the sun during climbing use. When in the unlocked position, the cover may be attached to the top of the end poles to create a shelter or lean-to with the climbing wall and above the climber.

It is a benefit of the present invention to provide a free-standing climbing wall assembly having effectively, efficiently and securely mounted opposing hand hold structures. It is a further benefit to provide a free-standing climbing wall assembly utilizing a wall structure and securement ends which permit a variety of climbing wall configurations, i.e., linear, L-shaped, zig-zag shaped and other geometric wall configurations. It is a further benefit to provide a cover structure for both sides of a freestanding climbing wall. It is a further benefit of the invention to provide a wall closure system to secure the climbing wall system from unauthorized climbing during periods of non-use. It is a further benefit of the present invention to provide protection for an outdoor wall from the elements during use.

These and other benefits of this invention will become clear from the following description by reference to the drawings.

DESCRIPTION OF THE PREFERRED EMBODIMENTS

Figure 1:
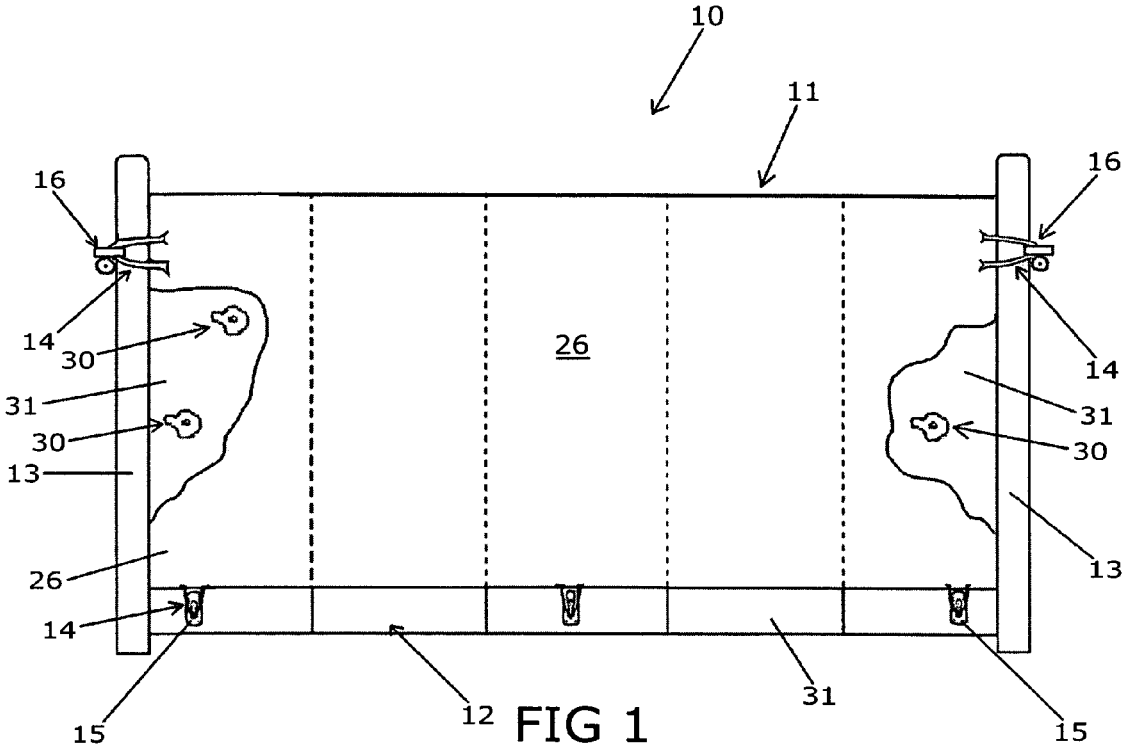
FIG. 1 is a frontal plan view showing the climbing wall assembly and wall closure system of the present invention.

A free-standing climbing wall assembly and a wall closure cooperating assembly. In a free standing climbing wall assembly, both sides of the climbing wall structure may be used for climbing, for example, by mounting individual hand holds on each side of the wall structure. The hand hold structures may be cooperating structures which are joined or connected to each other. The wall closure assembly is provided to secure the climbing wall assembly by covering both climbing surfaces.

Referring to FIGS. 1-5, the climbing wall assembly 10 is shown having a climbing wall structure 12 which may be formed of one or more wall panels 31. The wall panels 31 are shown mounted and held between securement structures, such as side poles 13. For example, wall structures 12 may be provided in any width between side support structures 13 and may be constructed of any rigid and strong material, i.e., polymeric, wood, laminations thereof, and the like. The wall structures may also use a plurality of support structures, i.e. in elongated, L-shaped or other climbing wall configurations. A closure or cover system 11 is shown comprising a generally rectangular mat or covering structure 16 having securement means 14, i.e., loop members comprising a flexible looped body 27 extending from the side and bottom of the covering structure 26. Climbing wall panels 31 with opposing surfaces are shown secured between end poles 13 so that the wall assembly is free standing, i.e. not attached to a back support wall structure, so that both the front and rear sides of the climbing wall can be used for climbing. The rectangular covering or sleeve structure 26 of the closure systems 11 is shown to extend over and cover both sides of the climbing wall 12. Securement means such as loop members 14 are shown attached and located along the side and bottom periphery of covering structure 26 and are for the securement of the wall closure system 11 to the end poles 13, for example. End support structures 13 may be constructed of a strong, rigid material, i.e., a coated metal, wood, a polymeric material or the like. When used in an indoor setting, the securement structure may further utilize base plates or other support securement means known in the art.

Figure 5:
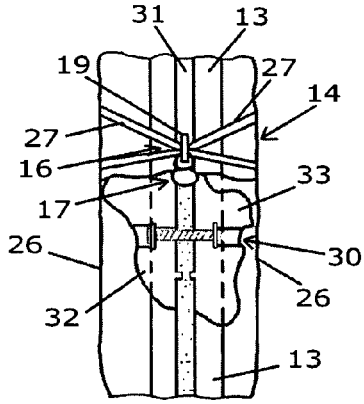
FIG. 5 is a sectional view of the climbing wall assembly and wall closure system of the invention.

As particularly shown in the sectional view of FIG. 5, wall panel 31 is shown extending from support structure 13 and having a double hand hold structure 30 mounted to the front and rear surfaces of the wall panel 31. Specifically, hand hold structures 32 and 33 and shown interconnected through wall panel 31 to form double hand hold structure 30. Further, wall cover structure 11 comprising cover member 26 and strap means 14 are shown secured to locking means 16 comprising an eyebolt mounted to support poles 13 and a lock structure 17 with a shackle to secure the cover member 26 over the wall panel 31 and hand hold structures 32 and 33.

Figure 2:
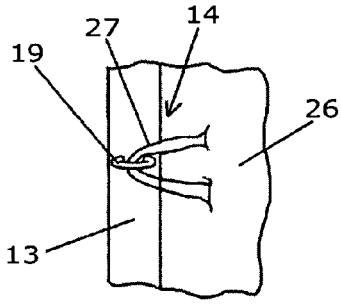
FIG. 2 is a frontal view of a wall closure and securement system of the invention.
Figure 3:
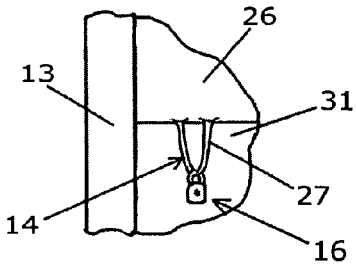
FIG. 3 shows another securement structure of the invention.

Referring to FIGS. 2-5, the loop members 14 having flexible bodies 27 may be fastened in various ways to secure the covering structure 26 of the closure system 11. For example, the loop members 14 may be secured around the side support poles 13 as shown in FIG. 1, and may also be further secured at the bottom of the climbing wall 12 as shown in FIG. 3. Two opposing loop members 14 may be secured to each other using a lock member, i.e., using locks 16 and 17 (padlocks, for example) in FIGS. 1 and 5, or using other locking or securement means known in the art. As shown in FIG. 2, the loop members 14 may also be secured to a clasp or hook member 19 on the side support posts 13, and at the bottom of the covering to ground hooks 18, shown in FIG. 4. The attachment member 19 may be used on both sides of support post 13, to thereby secure more than one cover member when an L-shaped or zig-zag wall structure is secured and when a plurality of securement posts, wall structures and cover members are utilized. As shown in FIG. 1, the loop members 14 located near the bottom of the climbing wall 12 may also be secured to the wall using safety hand hold structures 15 which are disclosed in the above referenced U.S. Patent Application No. 60/545,543 ('543 application), and which is incorporated by reference herein.

Figure 4:
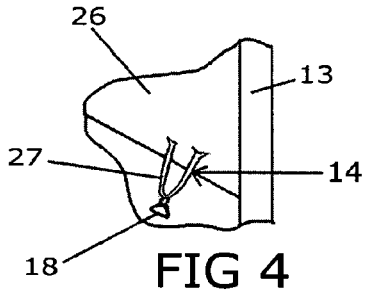
FIG. 4 shows another securement structure for the cover structure of the invention.

Preferably, the security hand hold structures disclosed in the '543 application may be mounted on both sides near the base of the freestanding outdoor climbing wall 12 to secure the cover structure 11 to the climbing wall structure. The cover member 26 may be constructed of natural or synthetic matting materials, for example, vinyl, mesh or similar flexible and pliable materials known in the art. Preferably, the bottom portion of the cover member 26 includes loop members 14 that fit into the security hand hold structures 15 and to be locked into place to secure the cover member structure 26. The loop members 14 may also be secured to the climbing wall via locks that are fixed in place or to be attached to permanent anchors 18 secured in the ground adjacent to the climbing wall, i.e., as shown in FIG. 4. Grommets may also be utilized at the bottom of the cover member 26 for securing the covering to such locks and/or anchors. The cover structure 11 may also include the use of a cable as a securement means to secure the cover member 26 to the climbing wall assembly 10 during periods of non-use. The cable may cooperate with the locking hand hold 15, a lock, a ground hook or other attachment member. The sides of the cover member 26 are also preferably secured and locked into place, i.e., as shown in FIGS. 1 and 2, to prevent access under the cover member 26 during periods of non-use.

Figure 6:
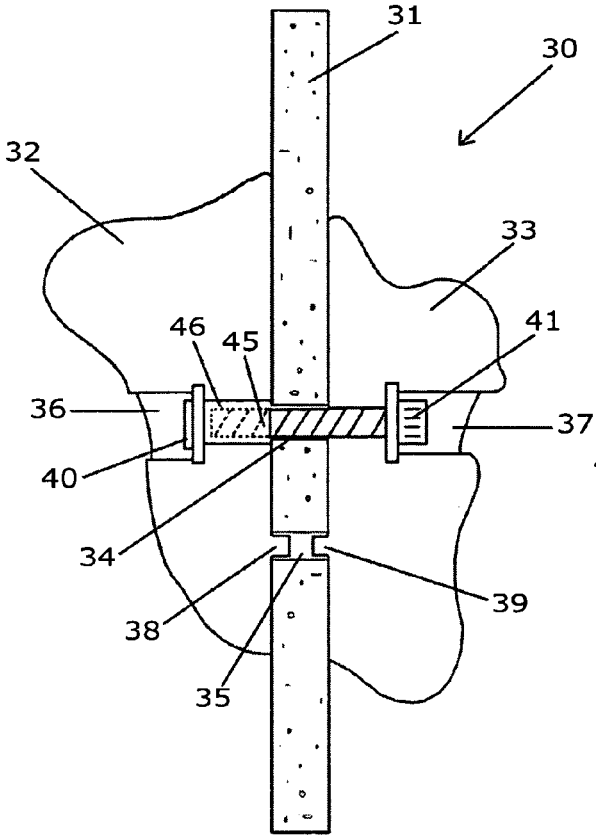
FIG. 6 is a sectional view showing the double-mounted hand hold structure of the present invention.

Referring to FIG. 6, a double mounted hand hold structure 30 is shown comprised of hand hold body members 32 and 33 which are shown disposed on opposite sides of climbing wall panel 31. A bolt member 41 having a head and threaded shaft 45 or like fastening member may be used to mount one of the hand hold bodies, shown as hand hold member 33, while cooperating female fastening member 40 with internally threaded portion 46 is shown used in the opposite hand hold body 32. The bolt member 41 with threaded shaft 45 is shown extending through aperture 37 in hand hold member 33 and extending through aperture 34 in climbing wall 31 and threaded into the internally threaded nut member 40 which is positioned in aperture 36 of hand hold member 32 on the opposite side of climbing wall panel 31. The bolt member 41 is tightened into nut member 40 to thereby securely mount both hand holds 32 and 33 on the opposing sides of climbing wall 31.

Figure 7:
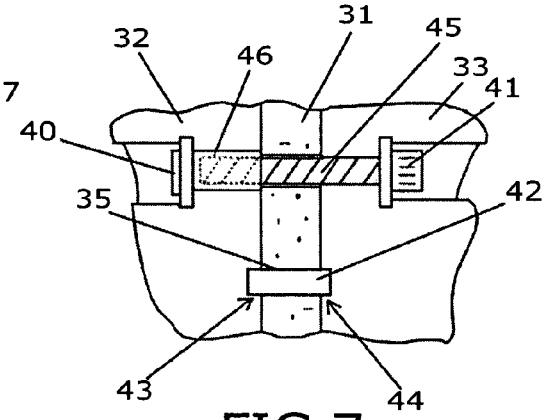
FIG. 7 is a partial sectional view of an alternate double mounted hand hold structure.

As further shown in FIG. 6, hand hold stabilizing means may be provided to prevent rotation. The handhold stabilizing means may be comprised of various structures, i.e., the use of a second attachment member, mechanical fasteners, i.e., a screw through the handhold and into the wall structure, an adhesive, etc., to secure the handhold body to the climbing wall structure. For example, aperture 35 through wall 31 is shown receiving formed protrusions or nub members 38 and 39 which extend from the back of hand hold body members 32 and 33, respectively, and which secure the respective hand holds by keeping the hand hold structures from rotating with respect to the connecting shaft of bolt 41. Alternatively, as shown in FIG. 7, a rod member 42 may be inserted through aperture 35 and to extend from both sides of climbing wall 31 to matingly fit into apertures 43 and 44 located in the back of the hand hold body members 32 and 33, respectively. Protrusions may also extend from and be unitary with the climbing wall panel 31 to matingly fit into such hand hold body apertures for hand hold stabilizing purposes.

The double mounted hand hold structures 30 of the present invention are constructed and arranged for use on any climbing wall on which climbing on both sides is desired, i.e. for both indoor and outdoor use. The hand hold structures may be formed in a variety of configurations.

Figure 8:
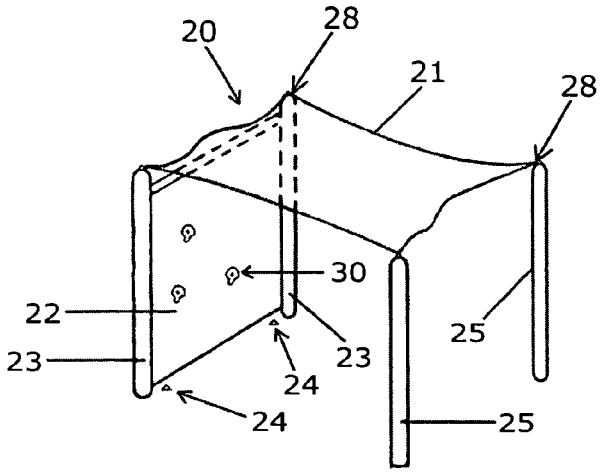
FIG. 8 is a perspective view of the shelter embodiment of the wall closure system of the present invention.

FIG. 8 shows embodiment 20 of the wall closure system and which is shown comprising a tarp-like covering 21 which may be used to form a lean-to or shelter structure to shield climbers from the elements when using the climbing wall 22. Climbing wall 22 is shown disposed between end poles 23. As shown in FIG. 8, when closure system 20 is in an open or unlocked position, it may be attached to the top of end poles 25 via securement means 28 and extended between the end poles 13 and 25 to create a shelter above and adjacent the climbing wall 22. When it is desired to place the closure system 20 in a closed position, the covering 21 may be secured to ground hooks 24, for example. The covering 21, although adapted to secure the climbing wall structure during periods of non-use, may be partially folded to provide the required cover area defined between the end posts 23 and 25. The securement means 28 may be comprised of any fastening structure known in the art.

As many changes are possible to the climbing wall assembly, double mounted hand holds and wall closure system of this invention, utilizing the teachings thereof, the description above and the accompanying drawings should be interpreted in the illustrative and not the limited sense.

That which is claimed is:

1. A climbing wall assembly comprising:

a) a climbing wall structure having opposing wall structure sides and an aperture therethrough;

b) opposing hand hold structures, each said hand hold structure having a hold body with a mounting surface and a generally curved exterior grabbing surface extending therefrom wherein said hold body has at least one bore therein and wherein said opposing hand hold structures are positioned on each opposing side of said climbing wall structure with said hold body bores aligned with said climbing wall aperture and having said mounting surface of each said opposing hold body abutting said wall structure side; and c) hand hold attachment means operative through said aperture of said climbing wall structure and through each said bore of said opposing hand hold structures to mount said opposing hand hold structures to said opposing wall structure sides of said climbing wall structure, and wherein said attachment means extends and is positioned entirely within said bores of said opposing hand hold structures so that said curved grabbing surface of each said opposing hold body is unobstructed by said attachment means.

2. The climbing wall assembly of claim 1, wherein said climbing wall structure has a hand hold stabilizing means operative on each said opposing side of said wall structure.

3. The climbing wall assembly of claim 2, wherein said hand hold stabilizing means comprises a second aperture in each said opposing side of said wall structure and wherein each said opposing hand hold structure has a protrusion for insertion into said second aperture.

4. The climbing wall assembly of claim 2, wherein said hand hold stabilizing means comprises either a second attachment means or a second aperture through said wall structure wherein each said hand hold structure having an aperture therein, and an elongated member for extending through said second aperture in said wall structure and for insertion into said aperture in said opposing hand hold structures.

5. The climbing wall assembly of claim 1, wherein a closure assembly is provided for covering said climbing wall structure and said opposing hand hold structures of said climbing wall assembly, said closure assembly comprising a flexible cover member and means to secure said cover member.

6. The climbing wall assembly of claim 5, wherein said means to secure said cover member comprises a loop member attached to said cover member and a locking structure cooperating with said loop member.

7. The climbing wall assembly of claim 1, wherein said hand hold attachment means comprises a slotted bore through each said hand hold structure and wherein a bolt member is provided for fastening within said slotted bores of said opposing hand hold structures.

8. The climbing wall assembly of claim 5, wherein said climbing wall structure is further comprised of first support structures having securement members and wherein said cover member has means to lock cooperating with said securement members.

9. The climbing wall assembly of claim 8, wherein a second support structure spaced from said first support structures is provided to receive said cover member to form a roof shelter extending therebetween.

10. A climbing wall assembly comprising:

a) a climbing wall structure having opposing sides and an aperture therethrough;

b) opposing hand hold structures, each said hand hold structure having a body with a curved grabbing surface and a bore therethrough, whereby said opposing hand hold structures are mounted on each opposing side of said climbing wall structure so that climbing can occur on either side of the climbing wall structure;

c) hand hold attachment means operative through said aperture of said climbing wall structure and said bore of each said hand hold structure to thereby mount said opposing hand hold structures to said opposing sides of said climbing wall structure; and d) hand hold stabilizing means operative on each said opposing side of said wall structure, said hand hold stabilizing means comprising a second aperture in said opposing sides of said wall structure and a corresponding fastening member for insertion therethrough.

11. The climbing wall assembly of claim 10, wherein said opposing hand hold structures each have a protrusion for insertion into said second aperture of said climbing wall structure.

12. The climbing wall assembly of claim 10, wherein each said hand hold structure has an aperture therein and wherein said fastening member of said hand hold stabilizing means comprises either a second attachment means or an elongated member for extending through said second aperture in said wall structure and for insertion into said apertures in said opposing hand hold structures.

13. The climbing wall assembly of claim 10, wherein said hand hold attachment means comprises a slotted bore through each said hand hold structure and wherein a bolt member is provided for fastening within said slotted bores of said opposing hand hold structures.

14. The climbing wall assembly of claim 10, wherein a closure assembly is provided for covering said climbing wall structure and said opposing hand hold structures of said climbing wall assembly, said closure assembly comprising a flexible cover member and means to secure said cover member, said climbing wall structure further comprising a first support structure having securement members, said cover member having locking means to cooperate with said securement members.

15. A climbing wall assembly comprising:

a) a climbing wall structure having opposing sides and an aperture therethrough;

b) opposing hand hold structures, each said hand hold structure having a body with a generally flat mounting surface and a curved grabbing surface extending therefrom, whereby said opposing hand hold structures are mounted on said opposing sides of said climbing wall structure so that climbing can occur on either side of the climbing wall structure;

c) hand hold attachment means operative through said aperture of said climbing wall to mount said opposing hand hold structures to said opposing sides of said climbing wall structure, said attachment means being located within said hand hold structure so that said curved grabbing surface of said hand hold structure is unobstructed by said attachment means; and d) a closure assembly for covering said climbing wall structure and said opposing hand hold structures, said closure assembly comprising a flexible cover member and means to secure said cover member.

16. The climbing wall assembly of claim 15, wherein said means to secure said cover member comprises a loop member attached to said cover member and a locking structure cooperating with said loop member.

17. The climbing wall assembly of claim 15, wherein said climbing wall structure is further comprised of first support structure having securement members and wherein said cover member has means to lock cooperating with said securement members.

18. The climbing wall assembly of claim 17, wherein a second support structure spaced from said first support structures is provided to receive said cover member to form a roof shelter extending therebetween.

19. The climbing wall assembly of claim 15, wherein said wall structure has a hand hold stabilizing means operative on each said opposing sides of said wall structure.

20. The climbing wall assembly of claim 15, wherein said hand hold attachment means comprises a slotted bore through each said hand hold structure and wherein a bolt member is provided for fastening within said slotted bores of said opposing hand hold structures.

* * * * *